US005730442A

United States Patent [19]

Anderson

[11] Patent Number: 5,730,442

[45] Date of Patent: Mar. 24, 1998

[54] SPORTS NET BACKSTOP

[75] Inventor: Ronald A. Anderson, Trenton, Wash.

[73] Assignee: Pacific Rim Supplies, Ltd., Seattle, Wash.

[21] Appl. No.: 563,183

[22] Filed: Nov. 27, 1995

[51] Int. Cl.[6] ..... A63B 69/36

[52] U.S. Cl. ..... 273/400; 473/197; 473/421

[58] Field of Search ..... 273/400, 411, 273/401, 407; 473/197, 421, 454, 462, 476, 478; 87/12, 13; 245/7

[56] References Cited

U.S. PATENT DOCUMENTS

| | | | |
|---|---|---|---|
| 2,679,368 | 5/1954 | Aigner | 245/7 |
| 2,922,653 | 1/1960 | O'Brien | 473/197 |
| 4,239,235 | 12/1980 | Torres | 273/411 |
| 4,420,158 | 12/1983 | Klock et al. | 273/400 |
| 4,703,931 | 11/1987 | Steen | 273/411 |
| 4,948,147 | 8/1990 | Pallanca | 473/411 |
| 5,054,791 | 10/1991 | Ball | 473/411 |
| 5,207,433 | 5/1993 | Moore | 273/411 |
| 5,452,896 | 9/1995 | Core | 473/197 |

*Primary Examiner*—Mark S. Graham
*Attorney, Agent, or Firm*—Ronald M. Anderson

[57] ABSTRACT

A backstop for use in limiting the flight of sports balls and other projectiles used in sports. One or more net panels (10, 10') are supported by a plurality of posts (60, 90) comprising an external frame. Preferably, cross members (64, 92) extend between the tops of the posts to provide additional support for the framework. Net panels are connected together to produce different configurations by, for example, wrapping a line around bound edges (12) that extend around the perimeter of each of the net panels. Tension lines connect the bound edges of the net panels to the external framework, to support the net panels in the desired configuration. Disclosed and described are a backstop (30) suitable for use in practicing driving a golf ball, and backstop (70) suitable for use behind a catcher's mound on a baseball diamond. Many other configurations can be made by linking varying numbers of the net panels together and supporting them with an external frame of suitable dimension and configuration.

2 Claims, 6 Drawing Sheets

SPORTS NET BACKSTOP

FIELD OF THE INVENTION

This invention generally pertains to a backstop for balls and other types of projectiles used in sports, and more specifically, to a backstop for this purpose that is made with net panels.

BACKGROUND OF THE INVENTION

There are many different sports activities in which a participant throws or hits a ball or other type of projectile (such as a FRISBEE™). Balls that are used in sports encompass a relatively wide range of sizes, e.g., covering the spectrum from a golf ball to a basketball. In certain sports, it is customary to provide a backstop, wall, or enclosure to limit the travel of the ball or projectile. A backstop is sometimes used to protect bystanders from being struck by a ball, such as is the case with a backstop disposed behind a catcher in a baseball game, or it may be used to limit the flight of a projectile, such as a batting cage, or to prevent a ball from traveling too far outside the boundary of play, such as a high fence surrounding a tennis court.

Those who are serious about practicing sports may not be able to conveniently travel to playing fields that allow sufficient space for hitting or throwing balls used in practicing a game. Practice that involves hitting or throwing a ball in a relatively small back yard may only be possible if some type of backstop is used to limit the travel of the ball. A permanent installation of such a backstop may not be practical. Commercial backstops are generally designed for a specific application, and for installation on a playing field intended for only one sport. A wire and metal backstop of this type is generally not sufficiently versatile or economical to be purchased by an individual for use in a residential yard. Due to the variety of configurations of sports backstops that are used for different purposes, it has generally not been considered economical to produce a low cost kit that would enable an unskilled person to erect a backstop in one of the many different configurations that might be needed for the various types of sports activities in which a projectile is hit or thrown.

Because of the range of ball sizes used in sports activities, a backstop intended for general purpose use should be able to block the smallest ball with which the backstop is likely to be used. Furthermore, the backstop should not permit the ball to bounce back toward the user, since injury to the user or others standing nearby might result. For example, if the backstop is used by someone practicing driving a golf ball, the backstop must absorb the kinetic energy of the golf ball, preventing the ball from being deflected back to strike the person who hit it (or others standing near that person).

For certain sports activities, a boxlike cage that is open at one end is an appropriate backstop. The cage may be relatively deep, for use in batting practice, or relatively shallow in depth, if used for a backstop when practicing the swing used for driving a golf ball. A backstop for use at one end of a tennis court to corral practice balls hit by a player after the balls are launched from a ball machine may be configured as a relatively tall and upright "V"-shaped panel. An economical system for constructing such diverse configurations and sizes of backstops is currently not available in the prior art.

SUMMARY OF THE INVENTION

In accord with the present invention, a system is disclosed for constructing a sports backstop to limit a flight of a projectile that is thrown or hit by a person practicing or engaging in a sports activity. The sports backstop includes a plurality of generally quadrilateral panels, each comprising a net having a mesh sized to prevent passage of the projectile through the mesh. A line is provided for coupling the panels together in a desired configuration, by binding an edge of one panel to an edge of another panel. Preferably, the line is passed through the mesh of the nets comprising the panels that are coupled together, along the edges of the panels. An external frame is disposed adjacent at least two edges of the desired configuration, and a plurality of tension lines connect the desired configuration to the external frame. The panels are thus supported by the external frame under tension, and the panels are spaced apart from the external frame to prevent the projectile from striking the external frame upon hitting the mesh. Any projectile striking one of the panels is deflected thereby, and the mesh absorbs energy from the projectile to prevent the projectile from rebounding to a position at which the projectile was thrown or hit.

In one preferred embodiment, the line comprises a plurality of ties that are spaced apart along the edges of adjacent panels, to join the edges together. Alternatively, the line comprises a length of cord.

The external frame preferably comprises vertical posts disposed adjacent to, but spaced apart from the sides and corners of the desired configuration.

In one embodiment of the net, the mesh comprises a plurality of hexagonal-shaped cells in which a cell is joined to two adjacent cells along opposite sides of the cell. The cells are formed with strands of a knitted material; the strands are knitted together to form a common side between two cells. In another embodiment, the mesh comprises a plurality of diamond-shaped cells formed of strands of a knitted material that are joined by knitting the strands together to form the mesh. The net preferably comprises strands of multiple plastic fibers.

In one form of the invention, the external frame comprises a plurality of tubes coupled together to form corners adjacent corners of the desired configuration. It is intended that the invention apply to an embodiment in which the external frame is freestanding. Portions of the external frame can alternatively be buried in the earth so that it is not freestanding.

Another aspect of the present invention is directed to a method for constructing a sports backstop in one of a plurality of different configurations. The sports backstop is used to limit a flight of a projectile that is thrown of hit by a person engaged in a sports activity. The method comprises steps that implement functions generally consistent with the system discussed above.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Figure 1:
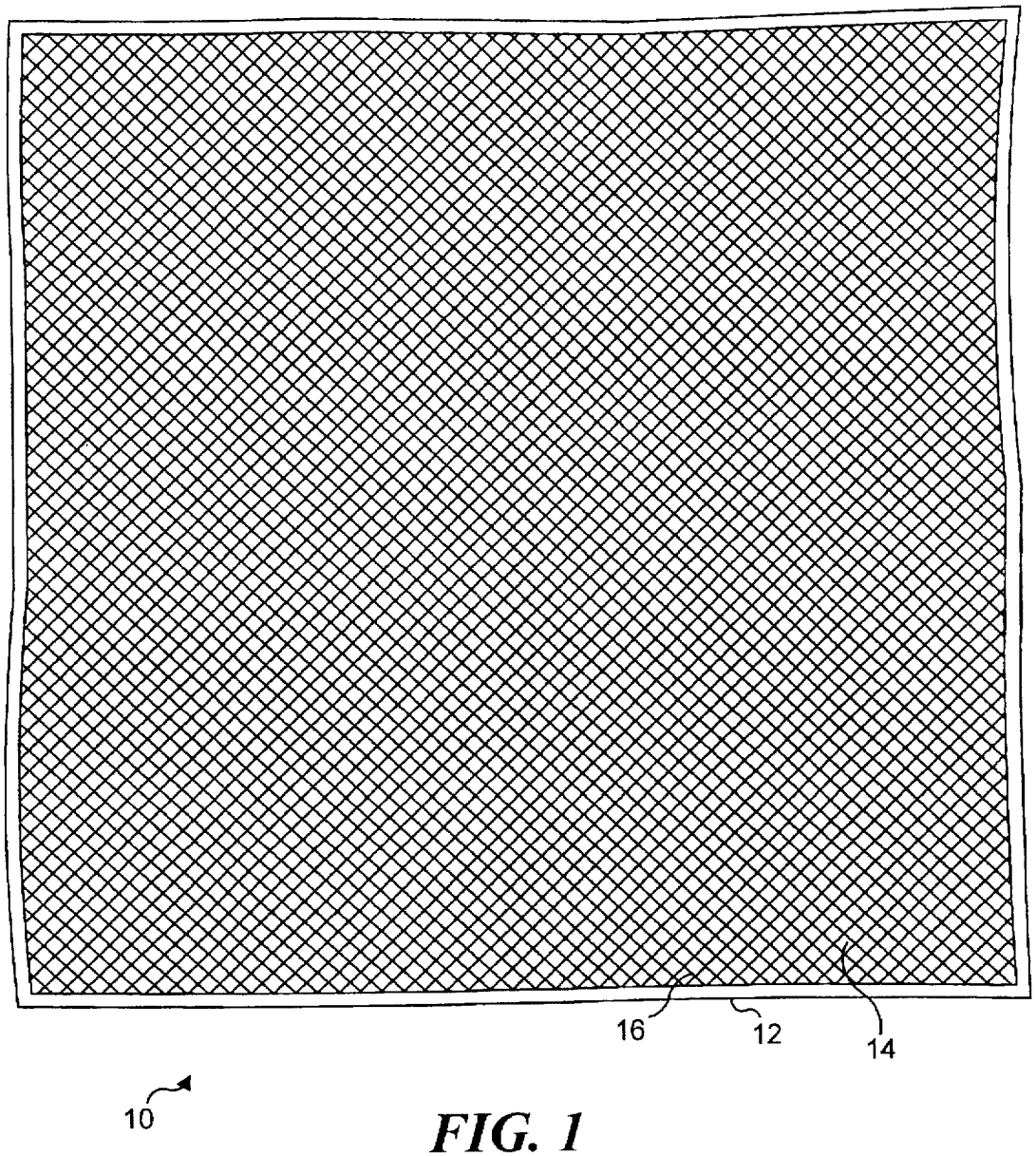
FIG. 1 is a plan view of one embodiment of a net panel used in constructing a sports backstop in the present invention.

As noted above in the Background of the Invention, a system for constructing various configurations of backstops and barriers for use in different sports should be adaptable and relatively low in cost. A building block approach is used in the present invention that enables a person to construct a backstop in a desired configuration using one or more net panels 10, as shown in FIG. 1. In the preferred embodiment, each net panel 10 comprises an eight-foot square section of netting having a bound edge 12 that extends around the perimeter of the section. The first embodiment of the invention employs a diamond (or square) mesh 14 that is formed by linking knitted strands 16 at spaced-apart intervals.

Figure 2:
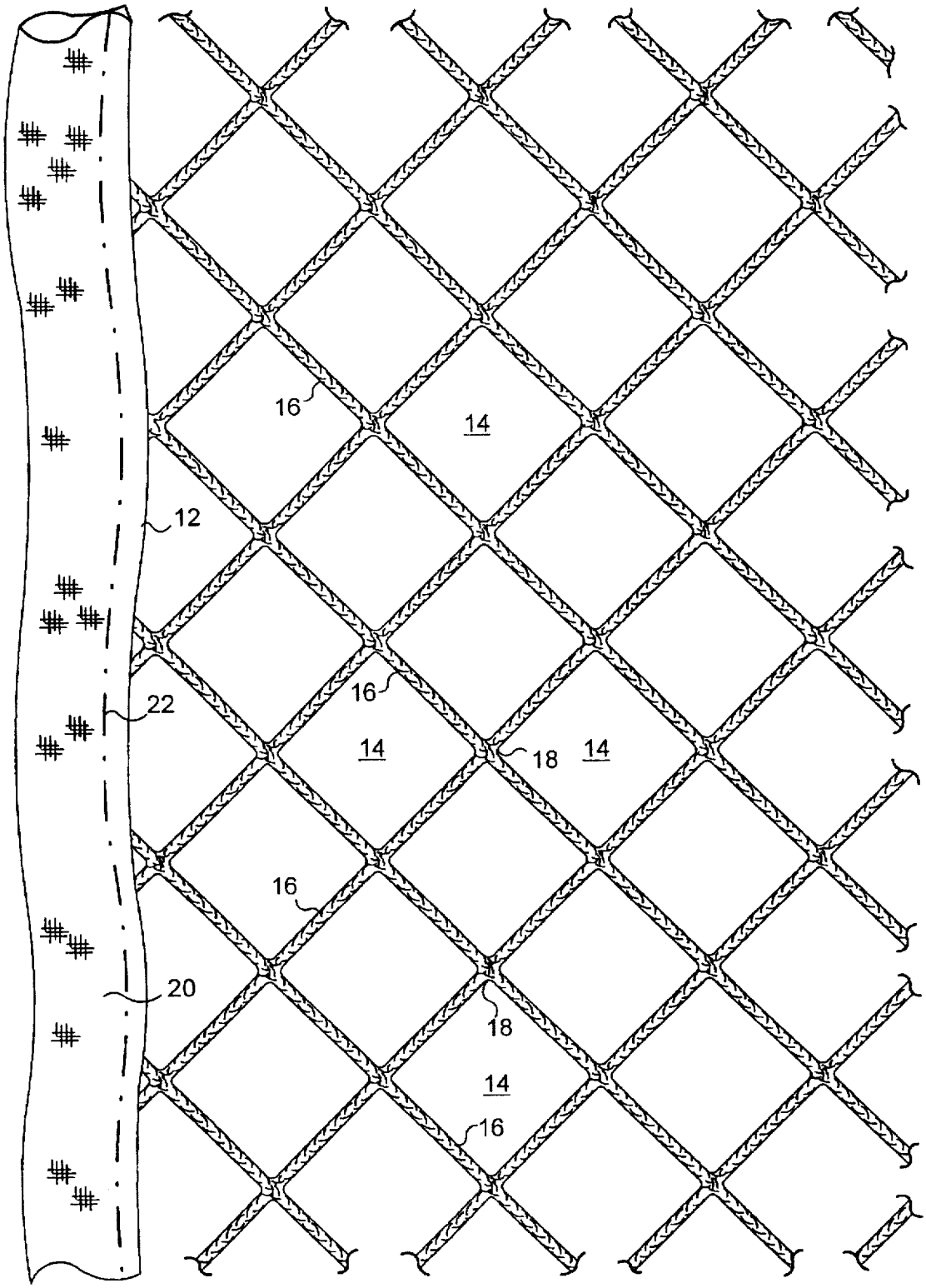
FIG. 2 is an enlarged portion of an edge of the net panel shown in FIG. 1.

FIG. 2 shows a slightly enlarged view of a portion of net panel 10 adjacent one edge. As will be apparent in this view, knitted strands 16, which extend diagonally in both directions, are joined at regularly-spaced nodes 18. Nodes 18 thus comprise the corners of the open cells or links comprising diamond mesh 14. In contrast to a conventional net, which employs twisted or braided threads that are knotted at spaced-apart intervals to define the cells of the mesh, strands 16 are knitted using multiple threads of nylon or other plastic material. At each node 18, the diagonally intersecting strands are knitted together to form a strong joint that is both resilient and relatively soft to the touch. The resiliency of net panel 10 enables it to absorb the kinetic energy of a fast-moving ball or other sports projectile that strikes the panel and thus reduce the rebound of the projectile. This characteristic of net panel 10 minimizes the risk that anyone standing nearby might be struck and injured by a projectile rebounding from the net panel.

Bound edge 12 extends around the periphery of diamond mesh 14 to cover the raw edge of the mesh when the netting comprising the panel is cut to size. The bound edge comprises a strip 20 of woven nylon fabric that is folded around the edge of the mesh panel so that the inside surface of the strip contacts opposite surfaces or faces of the netting. The strip is then secured in place by a line of stitching 22 (comprising a nylon thread) that extends along bound edge 12. The stitching extends through both the top and underlying portion of the strip, passing through the knitted strand 16, so that the strip is directly attached to knitted strands 16.

Figure 3:
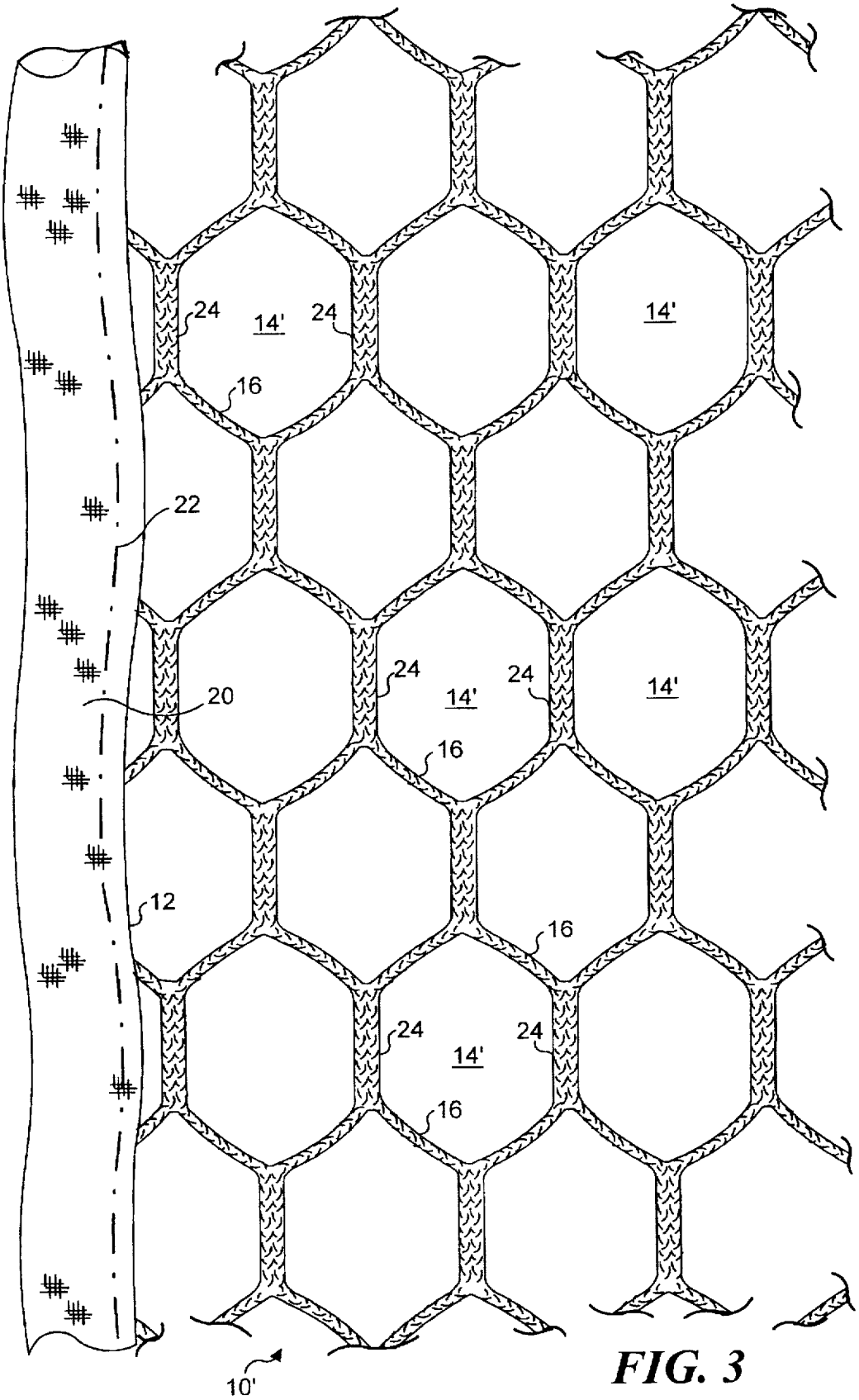
FIG. 3 is an enlarged portion of an edge of a second embodiment of the net panel.

In an alternative net panel 10', which is shown in FIG. 3, a hexagonal mesh 14' is formed using strands 16 that are knitted together along opposite sides 24 of each cell comprising the hexagonal mesh of net panel 10'. Sides 24 are each approximately twice as wide as any of the other four sides of each hexagonal cell, and these other sides comprise only a single strand 16. Bound edge 12 is also applied around the periphery of hexagonal mesh 14' in this second embodiment, and is secured to the hexagonal mesh using line of stitching 22, as described above.

Net panels 10 and 10' are preferably made using nylon or other plastic material that will withstand exposure to the elements, since the backstops constructed using net panels 10 or 10' are likely to be left outdoors for extended periods of time, where they will be exposed to moisture and to ultraviolet light produced by the sun. The netting used to construct net panels 10 and 10' employs a diamond or hexagonal mesh 14 or 14', respectively, which is sized to stop the smallest projectile likely to be used with a backstop constructed using either of the net panels. In the preferred embodiment, diamond mesh 14 and hexagonal mesh 14' have a gauge of about one inch, i.e., the maximum distance between any two corners when the mesh is distorted is approximately one inch. This size mesh insures that net panels 10 and 10' are able to stop a projectile as small as a golf ball, preventing it from passing through the cells comprising the mesh. Netting of the type described above is used in fish nets and is readily available from suppliers of such materials.

Figure 4:
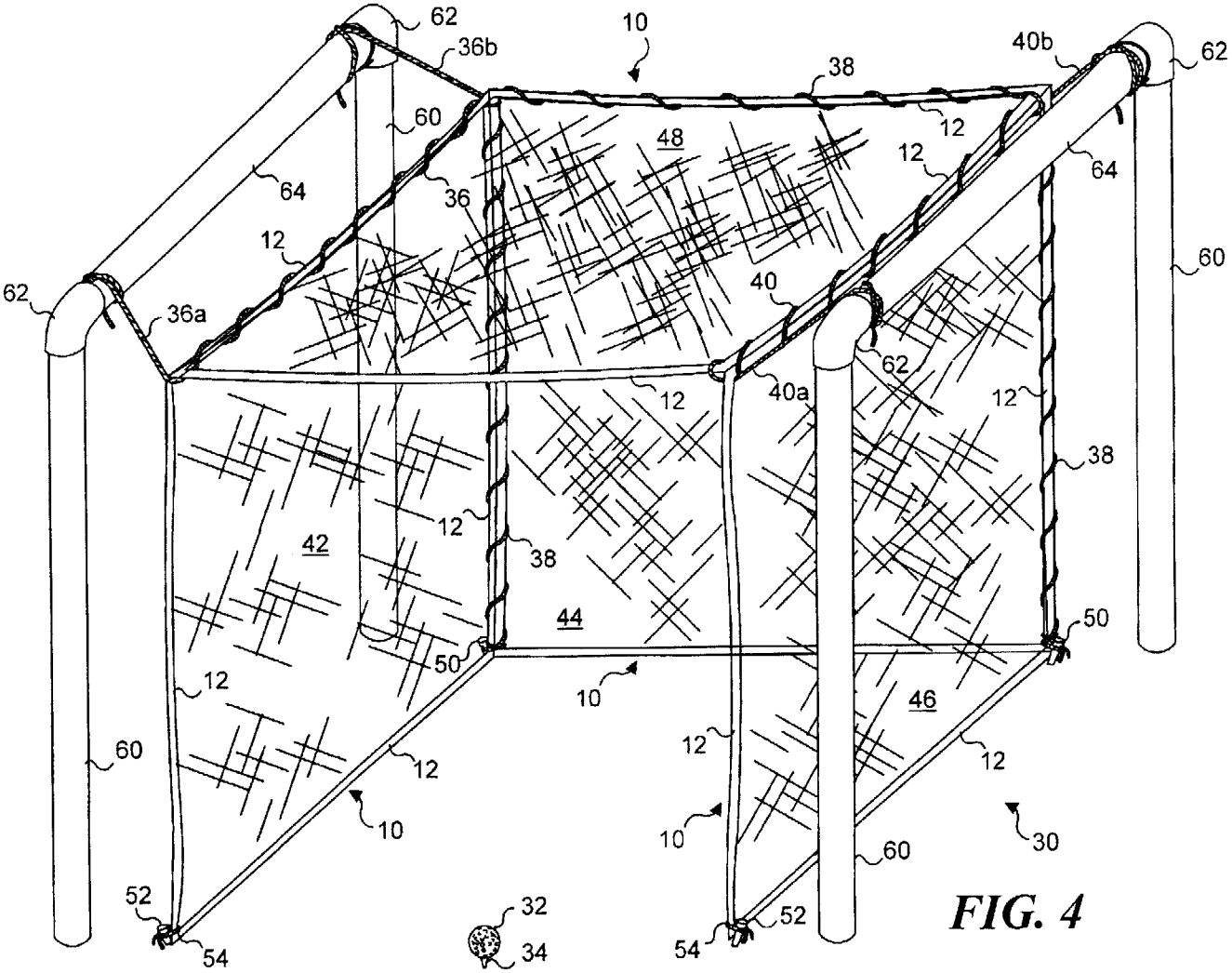
FIG. 4 is an isometric view of a first exemplary backstop constructed using a plurality of the net panels.

Turning now to FIG. 4, an exemplary backstop 30 is shown for use in connection with practicing driving a golf ball 32. It should be noted that due to the limited size available for the drawing, golf ball 32 is shown on a tee 34 substantially closer to backstop 30 than would be typical. Normally, golf ball 32 would be positioned on tee 34 approximately five feet from the front of backstop 30. At this distance, the swing of a golf club would clear the front of the backstop, but the backstop would be sufficiently close so that it would stop even a poorly driven ball.

Although many variations of a backstop suitable for use in practicing driving a golf ball can be constructed using the present invention, in this simple example, backstop 30 comprises four net panels 10 that are joined along their common edges to produce a cube shape structure that is open at the front and in the bottom. The four net panels respectively comprise a left side 42, a back 44, a right side 46, and a top 48. Bound edges 12 that extend along the top edge of left side 42 and left edge of top 48 are connected together using a line 36. Line 36 preferably comprises a nylon or other plastic cord, which is between 3/16 and 1/4 inch in diameter, that is wound around the two bound edges of left side 42 and top 48 by passing the cord through the mesh of the two net panels, so that the adjacent bound edges of the two net panels are held together tightly. At the left top front corner of backstop 30, the tag end of line 36 comprises a tension line **36*a* that is used to support the backstop. The lower left and right front corners of left side 42 and right side 46 are secured against the ground using pegs 52 and tiedown lines 54. Tiedown lines 54 preferably each comprise a short length, e.g., eight to twelve inches in length, of the cord used for line 36. Tiedown lines are looped around bound edges 12 at the lower front corners of left side 42 and right side 46, and tied around pegs 52**. The pegs are preferably driven into the earth to secure the lower bound edges of the net panels against the ground.

Similarly, pegs 50 are driven into the ground adjacent the left and right rear corners of backstop 30. The tag ends of a line 38 (or separate tiedown lines) are tied to pegs 50. Line 38, which comprises the same cord as line 36, is used to connect the rear bound edge of left side 42 to the left bound edge of back 44 by passing the line through the mesh of these two net panels and wrapping it around their adjacent bound edges, holding them tightly together. Line 38 continues along the top of back 44, connecting the top edge of the back to the rear edge of top 48 in the same manner. In addition, line 38 continues along the rear edge of right side 46, joining it to the right edge of back 44 by looping around the bound edges of the two net panels comprising this portion of the backstop. Line 38 is then tied off at the lower right back corner of backstop 30, after looping around peg 50.

A line 40, which comprises the same cord material as lines 36 and 38, is looped around the right edge of top 48 and the top edge of right side 46. The tag ends of line 40 comprise a tension line 40*a* that supports the front top right corner of backstop 30, and a tension line 40*b* that supports the rear top right corner of the backstop.

Although many other arrangements can be used for supporting backstop 30 and other such desired configurations of backstops made with the present invention, in the example shown in FIG. 4, backstop 30 is supported using four vertical posts 60. Vertical posts 60 preferably comprise six-inch diameter rigid polyvinyl chloride (PVC) tubing sections that are buried in the ground on their lower ends, extending vertically upright and spaced apart from the left and right sides of backstop 30. At the top of vertical posts 60 are disposed ninety degree elbows 62, which are in turn connected to cross members 64. These cross members extend from the front to the rear of backstop 30 and are disposed above and adjacent to the top edges of the left side and right side. Cross members 64 comprise the same type and size of PVC tubing used for posts 60. Ninety degree elbows 62 are joined to each of posts 60 and cross members 64 using an appropriate PVC adhesive, which partially dissolves the PVC, bonding the elbows to the posts and to the cross members. It should be noted that wooden or metal pipe posts and cross members can alternatively be used. However, the PVC tubing used for the external frame in backstop 30 are relatively lightweight and inexpensive. Most hardware stores carry such tubing for use in water systems.

Tension lines 36*a* and 36*b* are wrapped around the cross members, disposed on the left side of backstop 30, and tension lines 40*a* and 40*b* are similarly wrapped around the cross member that is adjacent the right side of the backstop. Since posts 60 and cross members 64 are outside the space enclosed by backstop 30, a golf ball or other projectile that is hit into the interior of the backstop cannot contact one of the posts or cross members and thus, cannot rebound from the hard surface of these frame members to strike someone standing outside the entrance to the backstop. Posts 60 and cross members 64 thus comprise an external framework that is intentionally spaced apart from the net panels to supports backstop 30. It should be noted that additional tension lines can be added, for example, at the midpoint of the left and right upper edges of top 48, left side 42, and right side 46. Furthermore, instead of using ninety degree elbows 62 on top of posts 60 adjacent the rear top corners of backstop 30, L-shaped tees (with three orthogonal openings) can instead be used, enabling an additional cross member (not shown) to be provided that extends adjacent the top rear corner of the backstop. Then, an additional tension line can be added at the midpoint of the added cross member to support the middle top of back 44.

Further modifications to the supporting external frame for backstop 30 could be provided to make the external frame freestanding. For example, a Tee fitting (not shown) can be attached to the bottom of each of posts 60 and short sections of PVC tubing (not shown) approximately one foot in length inserted into each side of the Tee fitting, producing feet for supporting the upright sections and providing a point adjacent each bottom corner of the backstop for securing the lower edge of the net panels instead of using pegs 50 and 52. By using the feet in combination with the added cross member adjacent the top rear corner of backstop 30, a relatively rigid freestanding external framework can be provided for supporting backstop 30.

It will be apparent that additional net panels 10 can be added to increase the depth, width, and/or height of backstop 30, thereby changing its shape and configuration. The additional net panels can be added by connecting the edges of each subsequent net panel added to adjacent edges of other net panels, in the same manner as shown and described in connection with backstop 30.

Figure 5:
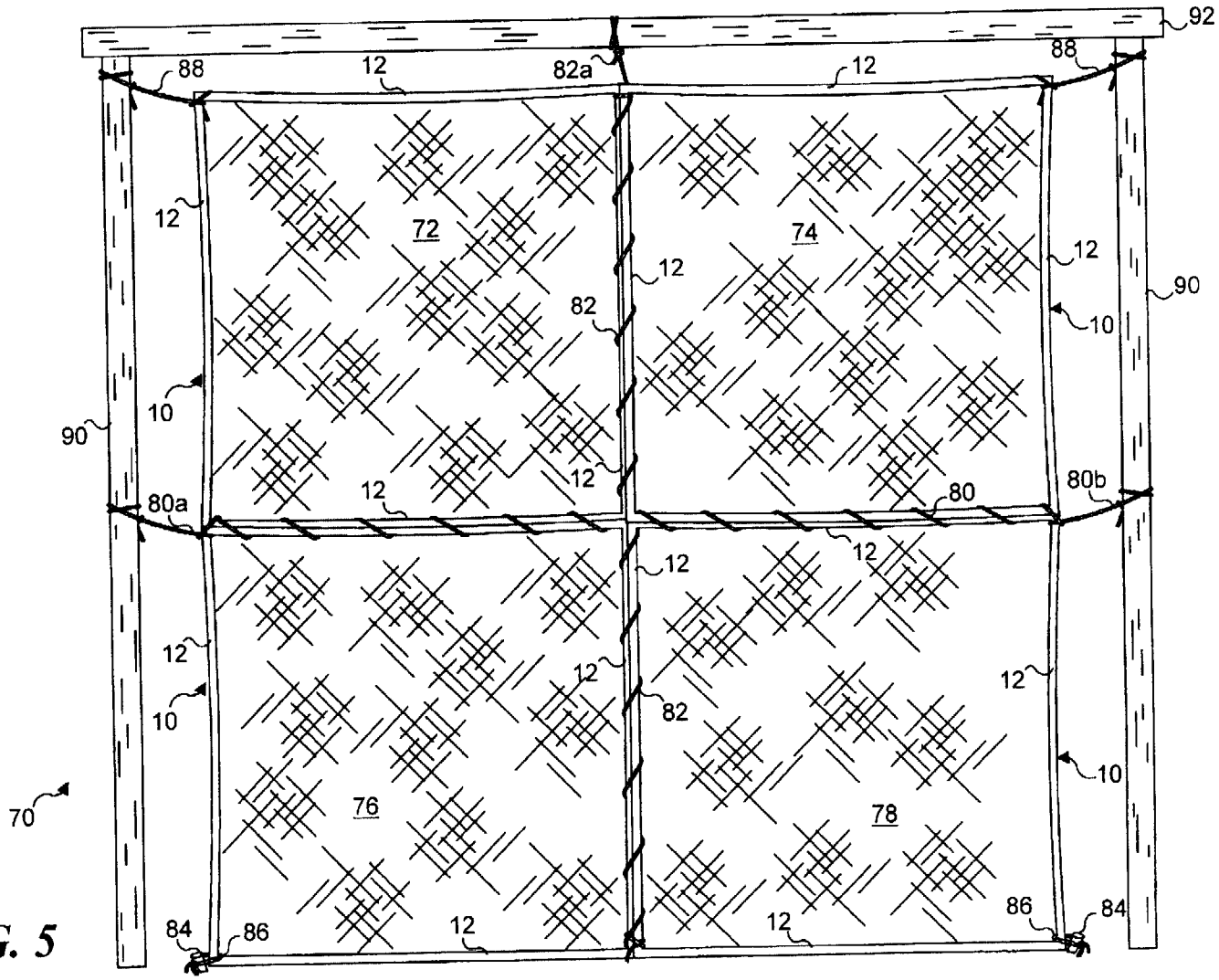
FIG. 5 is an elevational view of a second exemplary backstop constructed using a plurality of net panels.

A backstop 70, which is suitable for use behind a catcher mound for a baseball diamond is shown in FIG. 5. In this example, four net panels 10 are joined together to create a vertical square-shaped structure that is approximately 16' on each side. These four net panels include an upper left panel 72 that is joined to an upper right panel 74 using a line 82, which is wound around the adjacent edges of these two panels. A tag end of line 82 extends upwardly above the middle of the backstop to support its center. Line 82 continues downwardly to the bottom of the backstop, winding around the adjacent edges of a lower left panel 76 and a lower right panel 78, thereby tightly holding the bound edges of these two panels together. At the bottom of panels 76 and 78, line 82 is tied into a knot, but may also be attached to a peg (not shown), which is disposed behind the backstop and driven into the earth. Pegs 84 are disposed adjacent the lower outside corners of lower left panel 76 and lower right panel 78 and are driven into the earth. A short length of line 86 extends through the mesh of the adjacent corners of lower left panel 76 and lower right panel 78, and is looped around pegs 84, thereby securing the lower edge of the backstop to the ground. A line 80 is twined around the lower bound edge of upper left panel 72 and the top bound edge of lower left panel 76, thereby connecting these two net panels together. Line 80 extends further to connect the lower bound edge of top right panel 74 to the top bound edge of lower right panel 78. The tag ends of line 80 comprise tension lines 80*a*, for supporting the middle left side of the backstop and a tension line 80*b* for supporting the middle right side of backstop 70. In addition, tension lines 88 connect the upper left corner of top left panel 72 and the upper right corner of top right panel 74 to vertical posts 90, which are buried in the ground adjacent to and spaced apart from the left and right sides of the square panel, thereby providing support for the net panels. Tension lines 80*a* and 80*b* are also wrapped around and tied to posts 90. A cross member 92 is connected with nails or other suitable fasteners to posts 90, and extends above the tops of these two posts, completing the external frame for backstop 70. Plastic or metal tubing can also be used to construct the external frame. Additional tension members (not shown) can be added to the top bound edge of the panel and along the left and right sides, to provide additional support for the backstop.

Figure 6:
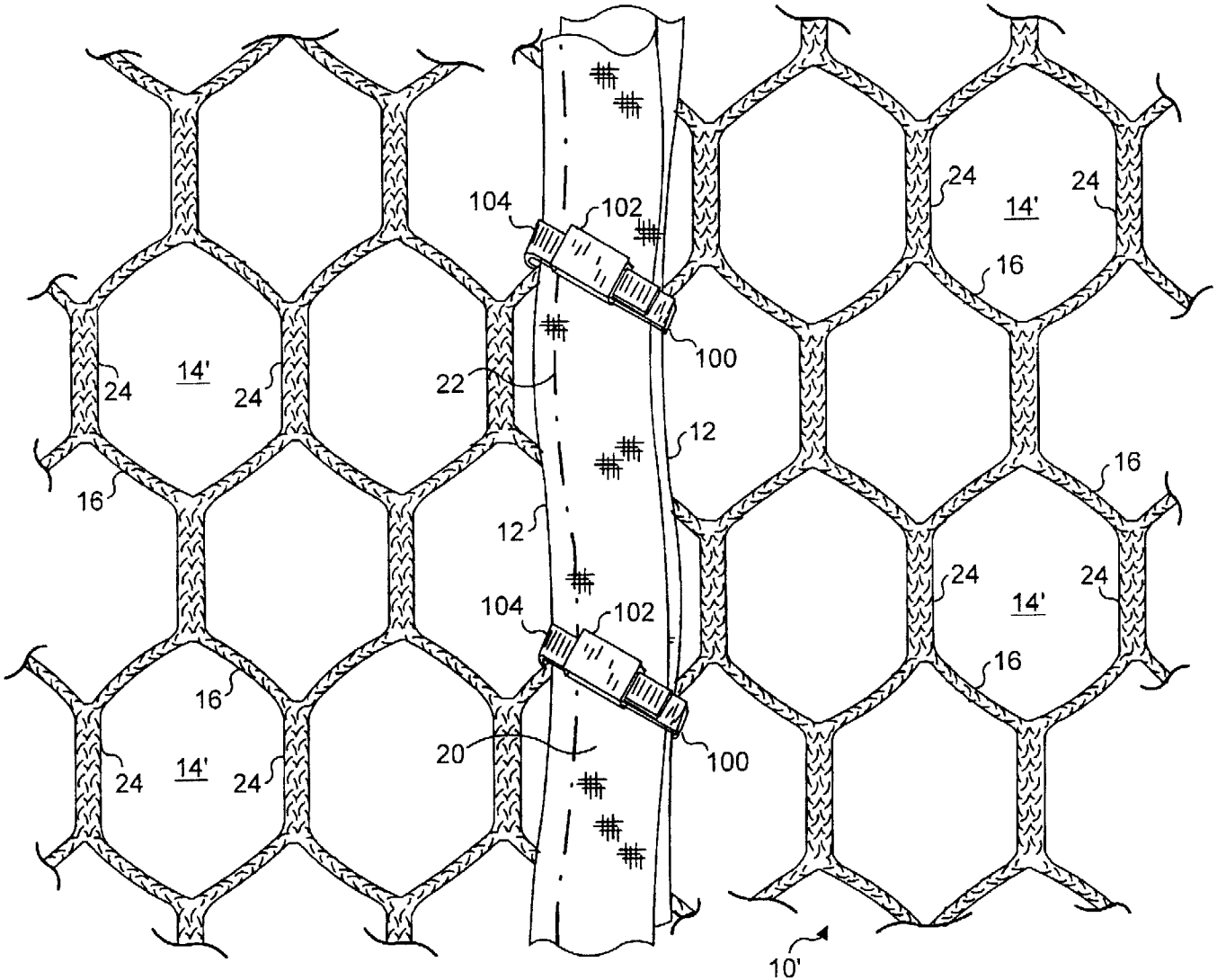
FIG. 6 is a section along the adjacent edges of two net panels (second embodiment) that are connected using plastic ties.

While only two configurations for backstops made in accord with the present invention are illustrated in FIGS. 4 and 5, it will be apparent that a virtually unlimited number of configurations for backstops can be constructed using net panels 10 or 10'. For a more permanent backstop, it is contemplated that the bound edges of adjacent net panels can be sewn together. Alternatively, the edges of adjacent net panels can be connected together using other materials besides the cord shown in the examples discussed above. For example, as shown in FIG. 6, plastic ties 100 like those used for securing electrical leads in wire bundles (and also used as temporary restraints on the wrists of prisoners) could be used to fasten the edges of adjacent net panels together. These plastic ties typically include a ratchet lock 102 on one end that enables a serrated surface 104 to freely slide through the ratchet lock when inserted therein, but prevents the inserted end of the plastic tie from being pulled back in the opposite direction. The plastic ties would be inserted through the mesh of net panels, wrapped around the adjacent edges of net panels 10 or 10', and the free end of the plastic tie inserted into the ratchet lock of the tie and pulled tight. By spacing the plastic ties at four to six inch intervals, the adjacent net panels are connected together. The extending tag ends of the plastic ties are then cut off.

It should be noted that for purposes of this disclosure and in the claims that follow, the term "line" is intended to encompass the lengths of plastic cord that are shown in the drawings for securing the edges of adjacent net panels together and any other form of flexible material, strands, wires, and short lengths of line (such as plastic ties 100).

Although the present invention has been described in connection with the preferred forms of practicing it and various modifications to the disclosed forms, those of ordinary skill in the art will understand that many further modifications can be made thereto within the scope of the claims that follow. Accordingly, it is not intended that the scope of the invention in any way be limited by the above description, but instead be determined entirely by reference to the claims that follow.

The invention in which an exclusive right is claimed is defined by the following:

1. A system for constructing a sports backstop to limit a flight of a projectile that is thrown or hit in a sports activity, comprising:

(a) a plurality of generally quadrilateral panels, each comprising a net having a mesh sized to prevent passage of the projectile through the mesh;

(b) a plurality of self-locking ties for coupling the panels together in a desired configuration, by binding an edge of one panel to an edge of another panel, each of said plurality of ties passing through the mesh of the nets comprising adjacent panels in the desired configuration, wrapping around the edges of said panels, and locking to form a closed loop around the edges of said panels;

(c) an external frame that is disposed adjacent at least two edges of the desired configuration of the backstop; and (d) a plurality of tension lines, said tension lines being employed to connect the desired configuration of the backstop to the external frame, said panels being thus supported by the external frame under tension so that the panels are spaced apart from the external frame to prevent the projectile from striking the external frame upon hitting the mesh, any projectile striking one of the panels being deflected thereby, said mesh absorbing kinetic energy from the projectile to prevent the projectile from rebounding to a position at which the projectile was thrown or hit.

2. A method for constructing a sports backstop in one of a plurality of different configurations, said sports backstop being used to limit a flight of a projectile that is thrown or hit, comprising the steps of:

(a) connecting a plurality of quadrilateral-shaped panels together along adjacent edges to form a desired configuration for the backstop, each panel comprising a net having a mesh sized to prevent the projectile from passing through the mesh, a plurality of self-locking ties being used for coupling the panels together in a desired configuration by binding an edge of one panel to an edge of another panel, each of said plurality of ties passing through the mesh of the nets comprising adjacent panels in the desired configuration, wrapping around the edges of said panels, and locking to form a closed loop around the edges of said panels;

(b) providing an external frame to support the plurality of panels connected together in the desired configuration; and (c) connecting the external frame to the plurality of panels using a plurality of tension lines, said tension lines connecting the panels to the external frame under tension, so that the external frame is spaced apart from the panels and is disposed outside and spaced apart from the desired configuration sufficiently far to ensure that the projectile does not strike the external frame after striking the net, said mesh absorbing the kinetic energy of the projectile so that the projectile does not rebound to a position from which the projectile was hit or thrown.

* * * * *